US006062372A

United States Patent [19]

Cote et al.

[11] Patent Number: 6,062,372

[45] Date of Patent: May 16, 2000

[54] POST-FOLDER DIVERTING APPARATUS USING PARALLEL DRIVES

[75] Inventors: Kevin Lauren Cote; Charles Henry Dufour, both of Durham, N.H.

[73] Assignees: Heidelgerg Web Press, Inc., Dover, N.H.; Heidelberger Druckmaschinen AG, Heidelberg, Germany

[21] Appl. No.: 08/914,313

[22] Filed: Aug. 13, 1997

[51] Int. Cl.[7] ..... B65G 47/26

[52] U.S. Cl. ..... 198/440; 198/570; 271/204

[58] Field of Search ..... 198/440, 449, 198/570, 601; 271/204, 9.04, 9.13; 270/58.23, 58.25, 58.33

[56] References Cited

U.S. PATENT DOCUMENTS

| | | | |
|---|---|---|---|
| 2,325,862 | 8/1943 | Jepson | 198/449 |
| 3,339,701 | 9/1967 | Weichhand | 198/449 |
| 3,390,508 | 7/1968 | Heimlicher | 198/440 |
| 3,635,322 | 1/1972 | Raudat er al. | 198/440 |
| 3,809,214 | 5/1974 | Reist . | |
| 4,072,228 | 2/1978 | Honegger et al. . | |
| 4,550,822 | 11/1985 | Meier . | |
| 4,678,172 | 7/1987 | Faltin | 198/440 |
| 5,007,624 | 4/1991 | Chandhoke | 271/204 |
| 5,443,254 | 8/1995 | Reist . | |
| 5,452,886 | 9/1995 | Cote et al. . | |
| 5,560,599 | 10/1996 | Curley et al. . | |

FOREIGN PATENT DOCUMENTS

| | | |
|---|---|---|
| 0 309 702 | 4/1989 | European Pat. Off. . |
| 0 399 188 | 11/1990 | European Pat. Off. . |
| 0 633 212 | 1/1995 | European Pat. Off. . |
| 0 819 635 | 1/1998 | European Pat. Off. . |
| 196 21 331 | 1/1997 | Germany . |

*Primary Examiner*—Jospeh E. Valenza
*Attorney, Agent, or Firm*—Kenyon & Kenyon

[57] ABSTRACT

A post folder diverting apparatus includes a first and second conveyor system, each having a conveyor drive, a conveyor cable, a plurality of gripper blocks connected to each conveyor cable and a gripper element attached to each gripper block for transporting signatures from a folder apparatus to separate product streams. The first and second conveyor cables are configured to follow a parallel path for part of the way and separate paths for part of the way. Each gripper block has a first recess for receiving the cable to which it is attached, and a second recess for allowing the other cable to pass through the gripper block without contacting it. The recesses in the gripper blocks are sized and spaced so as to allow gripper blocks attached to the first conveyor cable to share a common path with gripper blocks attached to the second conveyor cable where the conveyor cables follow parallel paths and to deviate from one another where the conveyor cables diverge.

10 Claims, 9 Drawing Sheets

Fig. 1
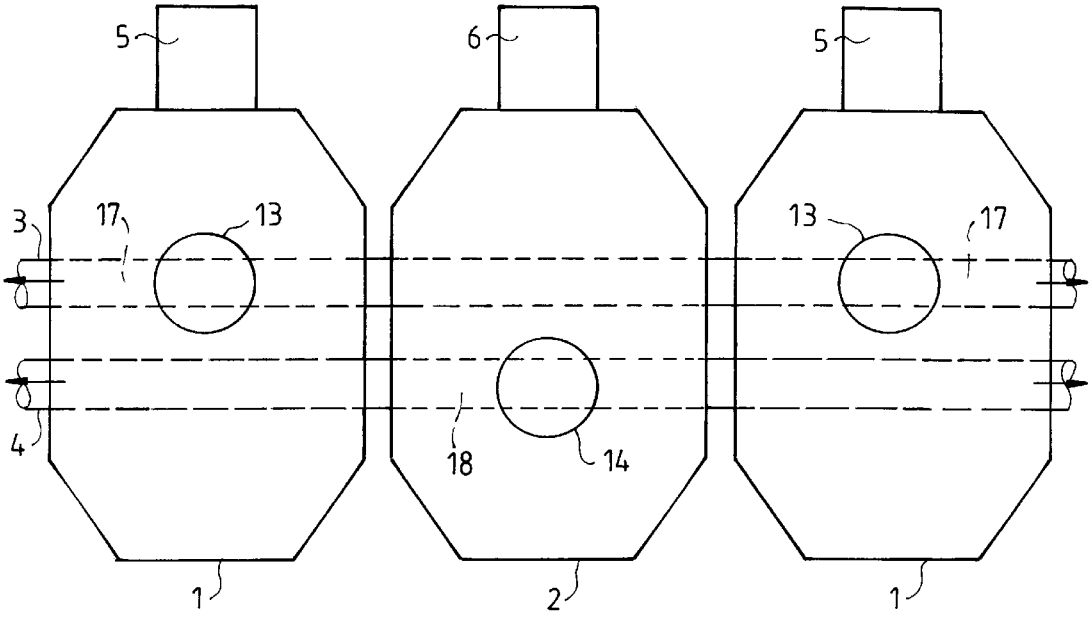
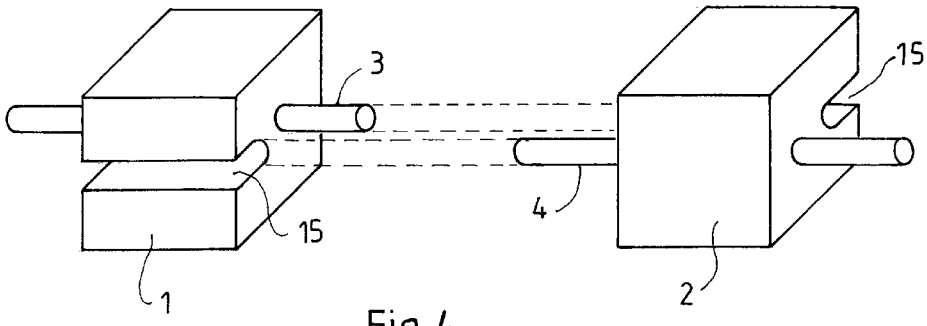
Fig. 4

200
130
130.5
130.1
1300
140
280
150
220
190
230

POST-FOLDER DIVERTING APPARATUS USING PARALLEL DRIVES

FIELD OF THE INVENTION

The present invention relates to an apparatus for separating two or more versions of flat products, especially printed signatures, into separate secondary product streams from a single imbricated product stream.

BACKGROUND INFORMATION

A common step in producing printed products using web offset printing press technology includes forming, folding and cutting a continuous paper web to form printed products, referred to as signatures. According to a conventional production method, the signatures exit from a folder apparatus after being processed by, for example, a fan wheel or deceleration device, which slows the speed of the signatures relative to the speed of the web. An example of such a deceleration device is described, for example, in U.S. Pat. No. 5,452,866. The signatures generally exit the folder for further processing on a conveyor in imbricated (e.g., shingled) fashion and in ordered series. It is important to maintain the ordering, or registration, of the signatures because the further processing typically involves combining multiple signatures, by binding or other means, to create a final product.

In web-offset printing, the image to be transferred onto the paper web is typically etched onto a printing plate mounted on a print cylinder. The ink image is transferred from the plate cylinder onto a blanket cylinder which then transfers the image onto the paper web. If, for example, the width of the printed image is less than one half the circumference of the print cylinder, multiple images can be printed with one rotation of the print cylinder. Accordingly, two separate products can be printed simultaneously onto a single web, which results in signatures for the first product exiting from the folder nested between signatures for the second product in a single imbricated stream. Thus, before the signatures can be further processed, it is desirable to separate the two signature versions without loss of registration.

U.S. Pat. No. 4,550,822 describes an apparatus for transporting flat products, especially printed products arriving in an imbricated formation. Each gripping unit of the apparatus comprises a stationary clamping jaw, a pivotable clamping jaw and a plate shaped stop. The pivotable clamping jaw is pivoted against the action of a closing spring by a cam structure or the like. The products are first accelerated and then pushed into the open gripper mouth until abutting the stop. Thereby, the printed products are aligned at the region of their leading edges. At their trailing edges the printed products remain under the conveying action of the belt conveyor at least until the gripper units are closed.

U.S. Pat. No. 4,072,228 describes an apparatus for evening an imbricated stream of printed products. This apparatus comprises a number of revolving entrainment members designed to engage the printed products and which are in a drag connection with one another. The entrainment members are driven by a thrust drive at the beginning of their conveying action path and by a traction drive at the end thereof. After the entrainment members engage the printed products, the thrust and traction drives cause a change in the spacing of the entrainment members and, consequently, in the spacing of the products.

U.S. Pat. No. 3,809,214 describes a turning conveyor for flat structures, especially printed products. This turning conveyor encompasses a plurality of entrainment members which move along with the flat structures. Each entrainment member can be brought into engagement with a respective one of the flat structures. The entrainment members are controlled such that, at least at the time they are in engagement with a flat structure, they turn relative to the direction of movement of the main conveyor, thereby turning the flat structures during the course of conveying same about an axis which is perpendicular to the flat structures.

Another known method of separating a stream of products uses a gripper conveyor system and a vacuum belt, such as are commonly used with newspaper gripper conveyor systems. In such a conventional gripper conveyor system, the gripper blocks are connected to one another, similar to links in a chain, and the gripper blocks form the conveyor cable. For example, such a gripper conveyor drags a stream of products over a vacuum belt traveling slower than the conveyor and releases every second flat product from the gripper conveyor onto the vacuum belt. This method of separating a stream of products has the disadvantage that it does not allow positive control of the signatures while separating them from a primary product stream to secondary product streams. More particularly, this method relies on the attractive force between the vacuum belt and the trailing edge of the released signature to maintain orientation of the signature. This degree of control is insufficient at high speeds or when transporting light products.

Therefore, with the foregoing in mind, it is a primary object of the present invention to provide a new and improved method and apparatus for separating two or more versions of flat structures, especially printed signatures, arriving from a folder in a single imbricated stream into two or more secondary streams without the loss of registration between the adjacent streams.

A further object of the present invention is to perform the separating of the signatures while maintaining positive control of the flat structures as they exit the folder, thereby maintaining reliability at high speeds and with light products.

SUMMARY OF THE INVENTION

According to the present invention, an apparatus is provided which controls each signature individually by gripping the signature as it is released from a folder in an imbricated stream and transporting the stream away from the folder. The grippers that control the signatures are attached to gripper blocks which are in turn connected to one of two conveyor cables that travel in parallel paths for the first part of the signature transportation away from the folder. The gripper blocks according to the present invention are not connected to adjoining gripper blocks but adjoining gripper blocks are separate and attached to one of two respective conveyor cables.

According to the present invention, the grippers that control the first set of signatures are guided, for example, by a first conveyor cable and the grippers that control the second set of signatures are guided, for example, by a second conveyor cable. The two conveyor cables follow parallel paths and use the same track and signature guide structure until the point where the first set of signatures are diverted away from the first set of signatures.

At this point, the second conveyor cable follows a path that deviates from the path of the first conveyor cable. Accordingly, the path of the second set of signatures diverts from that of the first set of signatures until they are separated from the first set of signatures. After the signatures are separated, they are released by the grippers onto, for example, separate belt conveyors resulting in separate imbricated streams for transport to conventional post-processing equipment. In another embodiment of the present invention, the gripper elements are rotated relative to the gripper block to provide each set of signatures in a folding edge leading presentation.

BRIEF DESCRIPTION OF THE DRAWINGS

FIG. 1 shows a top view of gripper blocks attached to conveyor cables according to the present invention;

FIG. 3(*b*) shows an exemplary deceleration device delivering signatures to a gripper conveyor system according to the present invention;

FIG. 3(*c*) shows a side view of the exemplary deceleration device shown in FIG. 3(*b*);

FIG. 4 shows a perspective view of a first and second gripper block and the corresponding conveyor cables according to the present invention;

FIG. 5(*b*) shows a top view of one of the grippers according to an embodiment of the present invention;

FIG. 5(*c*) shows a perspective view of one of the grippers further showing a cut-away view of the detail of the rotation and clamping mechanism according to an embodiment of the present invention; and FIG. 5(*d*) shows a perspective view of one of the grippers further showing a cut-away view of the detail of the rotation and clamping mechanism according to a second embodiment of the present invention

DETAILED DESCRIPTION OF THE INVENTION

Figure 2:
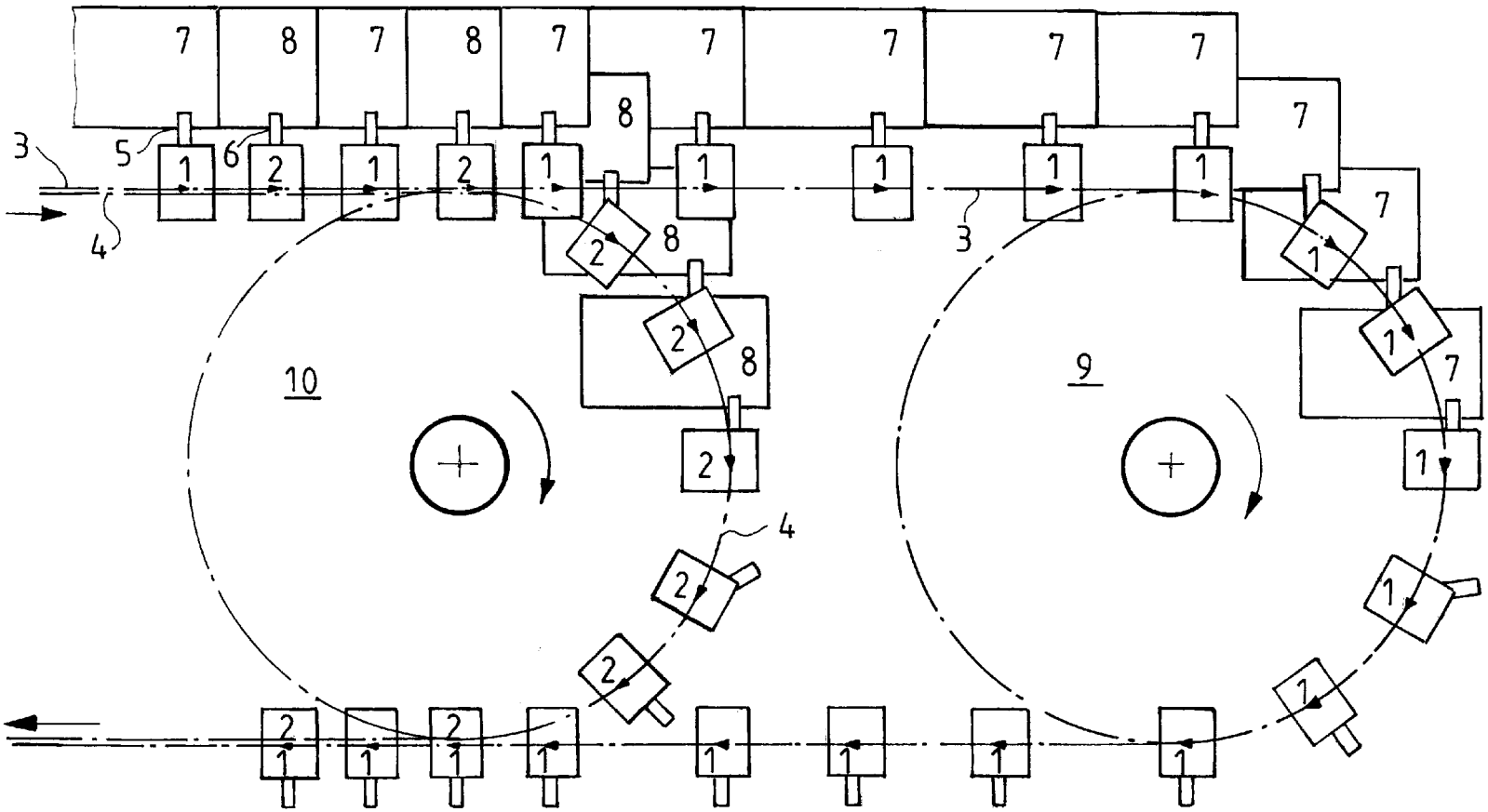
FIG. 2 shows an expanded top view of first and second conveyor systems according to the present invention.

FIG. 1 shows two exemplary styles of gripper blocks according to the present invention arranged in parallel formation. A first gripper block 1 is attached to a first conveyor cable 3 and to a first gripper element 5. A second gripper block 2 is attached to a second conveyor cable 4 and to a second gripper element 6. The gripper elements 5, 6 are known in the art and conventionally mounted to the respective gripper block 1, 2 via, for example, a bolted connection. For clarity, the gripper blocks and gripper elements are described here as separate units, however, the present invention also encompasses an embodiment in which gripper blocks and gripper elements are formed as a single unit.

First gripper block 1 has a first recess 17, for example generally cylindrical in shape, running through the gripper block to receive drive cable 3 to which it is attached.

Similarly, second gripper block 2 has a first recess 18, also generally cylindrical in shape, running through the gripper block to receive drive cable 4 to which it is attached. Gripper blocks 1, 2 and conveyor cables 3, 4 are respectively attached via, for example, a detente locking mechanism. For example, conventional spherical detente mechanisms 13, 14 in gripper blocks 1, 2 fit releasably and firmly around appropriately sized and spaced spheres attached to conveyor cables 3, 4, thereby maintaining the relative position of each of gripper blocks 1, 2 to their respective conveyor cable.

FIG. 4 shows a perspective view of a first gripper block 1 and a second gripper block 2 according to an embodiment of the present invention. In addition to first recess 17, each first gripper block 1 contains a second recess 15 to allow conveyor cable 4 to pass through without contacting gripper block 1. Similarly, in addition to first recess 18, each second gripper block 2 contains a second recess 16 to allow conveyor cable 3 to pass through without contacting gripper block 2. Second recesses 15, 16 in respective gripper blocks 1, 2 are sized and shaped so as to allow, for example, first gripper block 1 to divert to the left relative to the path of second conveyor cable 4, and to allow second gripper block 2 to divert to the right relative to the path of first conveyor cable 3. This construction allows gripper blocks 1, 2 to follow a common, parallel path for part of the way and divert into separate paths for part of the way, thereby accomplishing the task of separating the two different signatures from a single imbricated stream, as described below.

FIG. 2 depicts an embodiment of the post-folder diverting apparatus according to the present invention in which the two conveyor cables 3, 4 diverge from a common parallel path to separate the single imbricated stream of signatures 7, 8 into two separate product streams. For example, conveyor drive 9 rotates in a clockwise direction thereby driving conveyor cable 3 along the path as indicated. Similarly, conveyor drive 10 also rotates in a clockwise direction driving conveyor cable 4 along the path as shown. Each gripper element 5 is attached to a respective first gripper block 1 which in turn is attached to conveyor cable 3. As illustrated in FIG. 2, numerous first gripper blocks can be attached to conveyor cable 3. Similarly, each gripper element 6 is attached to a respective second gripper block 2 which in turn is attached to conveyor cable 4. In contrast to conventional gripper conveyor systems where adjoining gripper blocks are linked to form the conveyor, adjoining gripper blocks 1, 2 in the apparatus according to the present invention are separated from one another and attached to respective conveyor cables 3, 4.

Figure 3A:
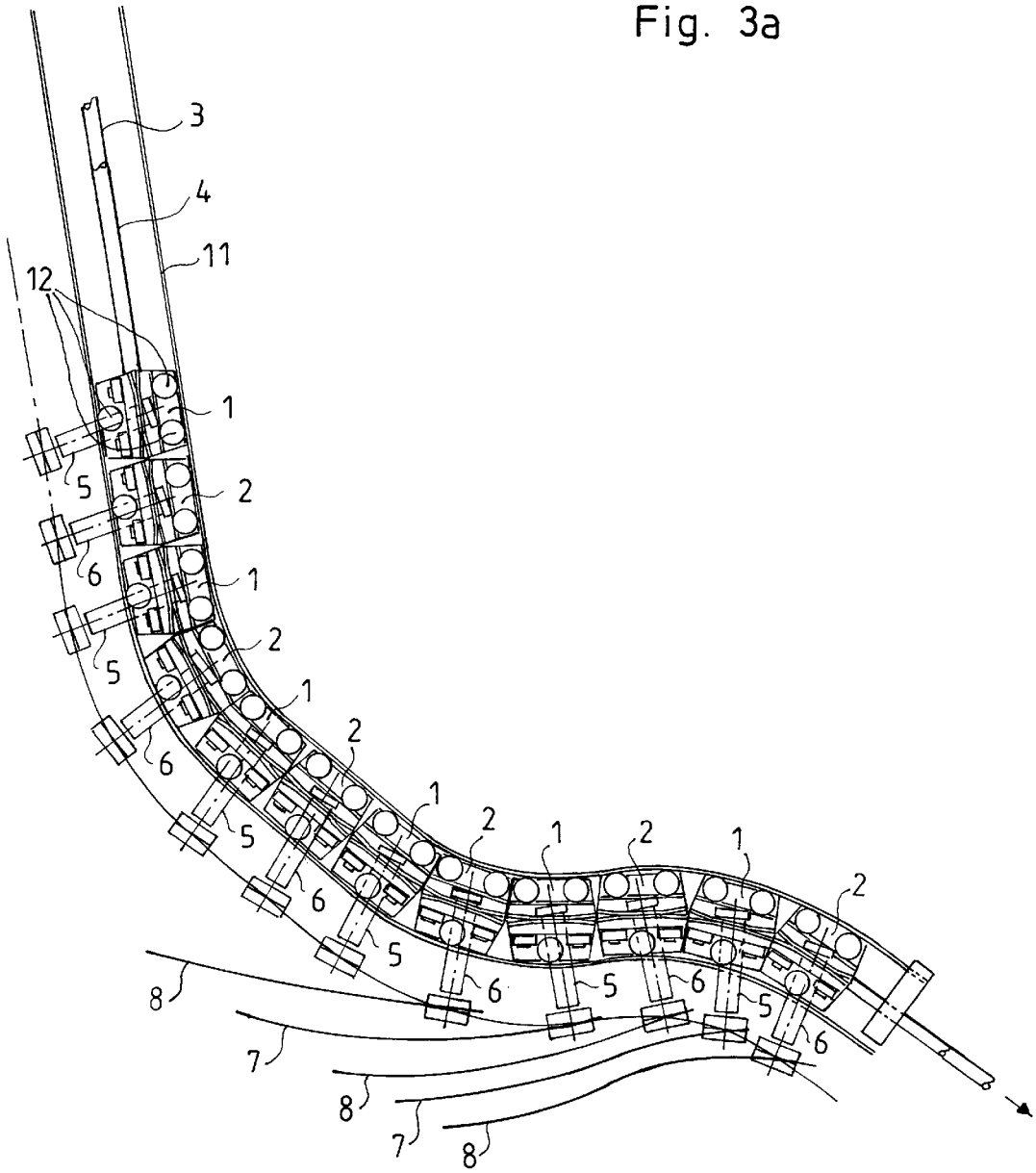
FIG. 3(*a*) shows a side view of the gripper blocks following a track and signature guide structure according to the present invention.
Figure 3B:
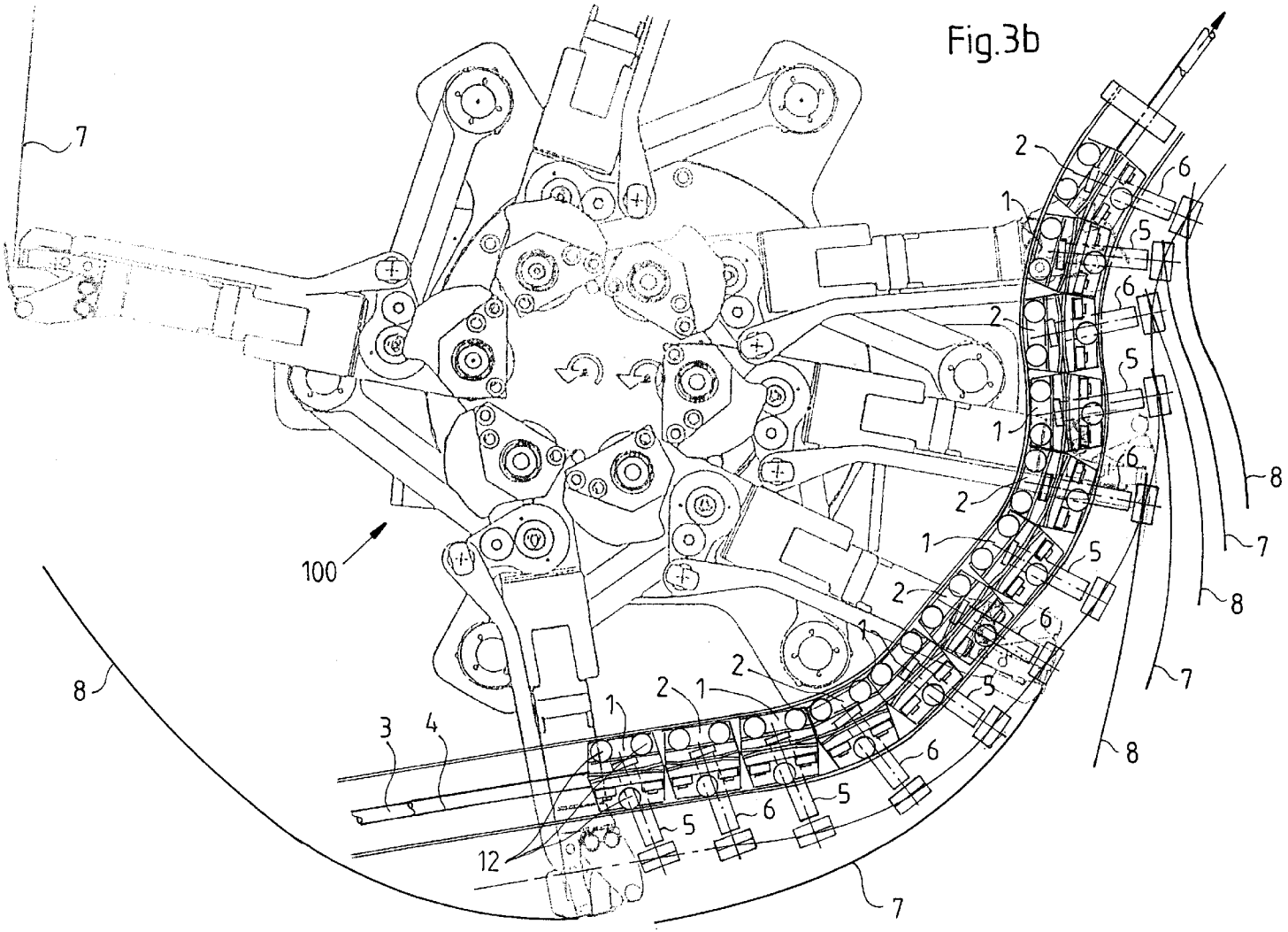
Figure 3C:
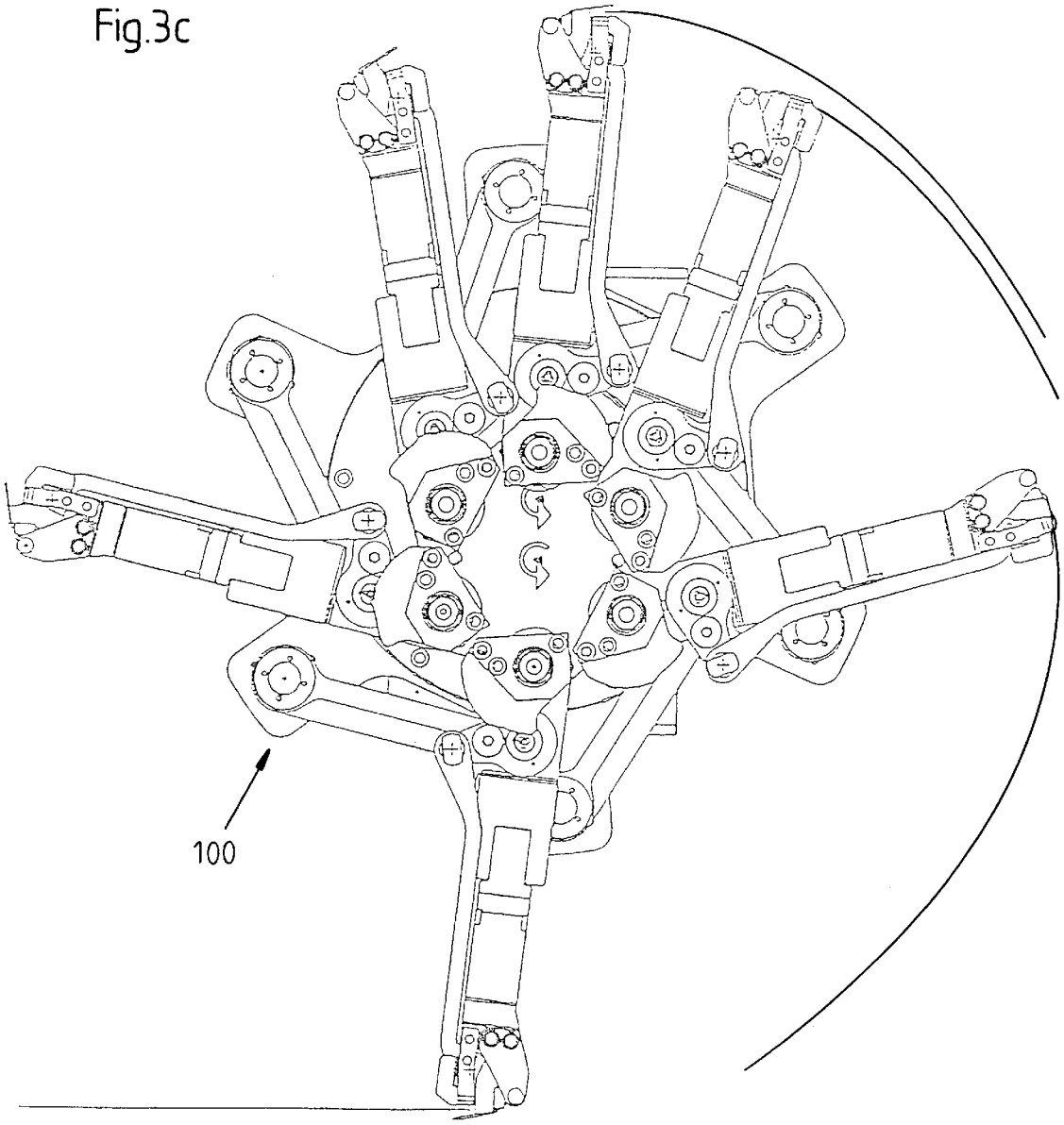
Figure 5A:
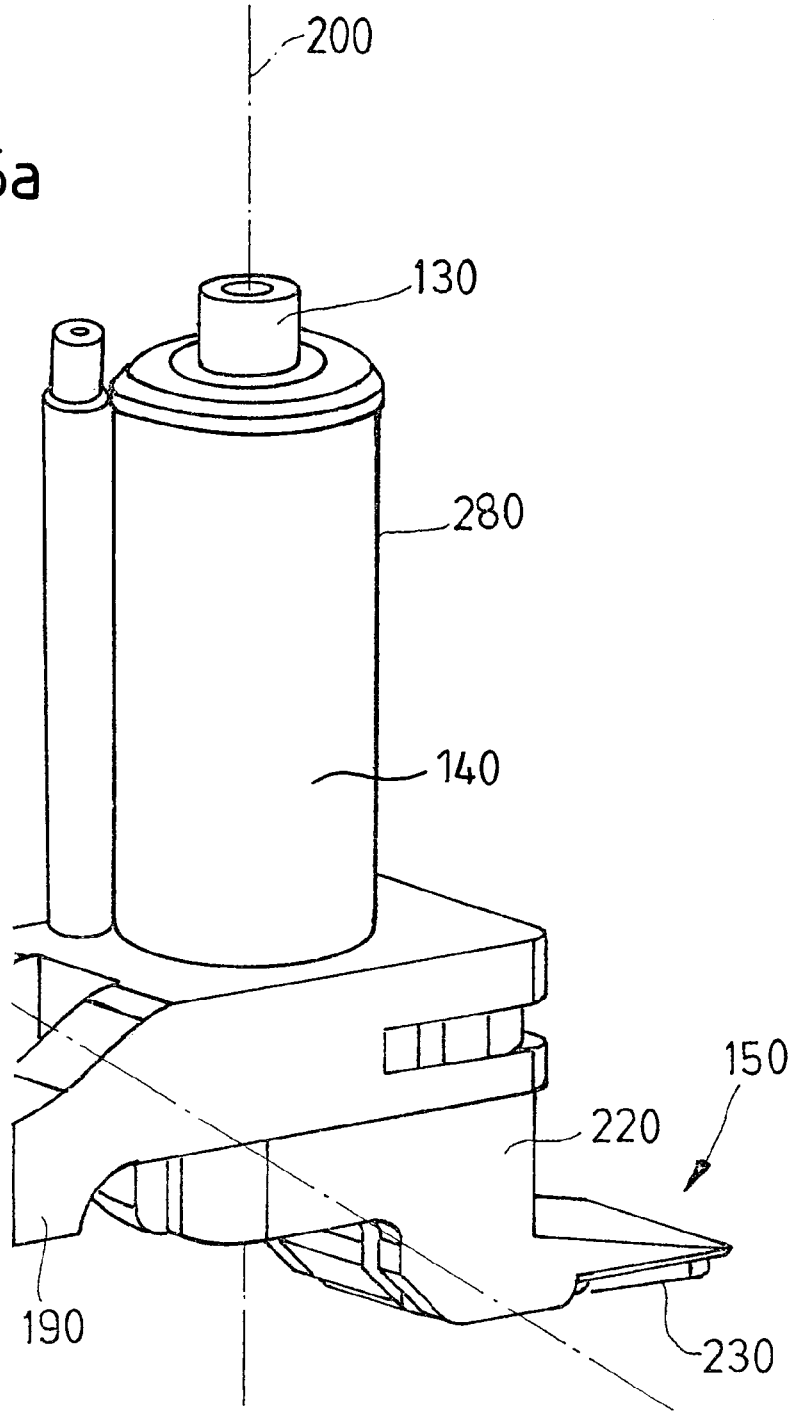
FIG. 5(*a*) shows a perspective view of one of the grippers in a conveyor system according to an embodiment of the present invention.
Figure 5B:
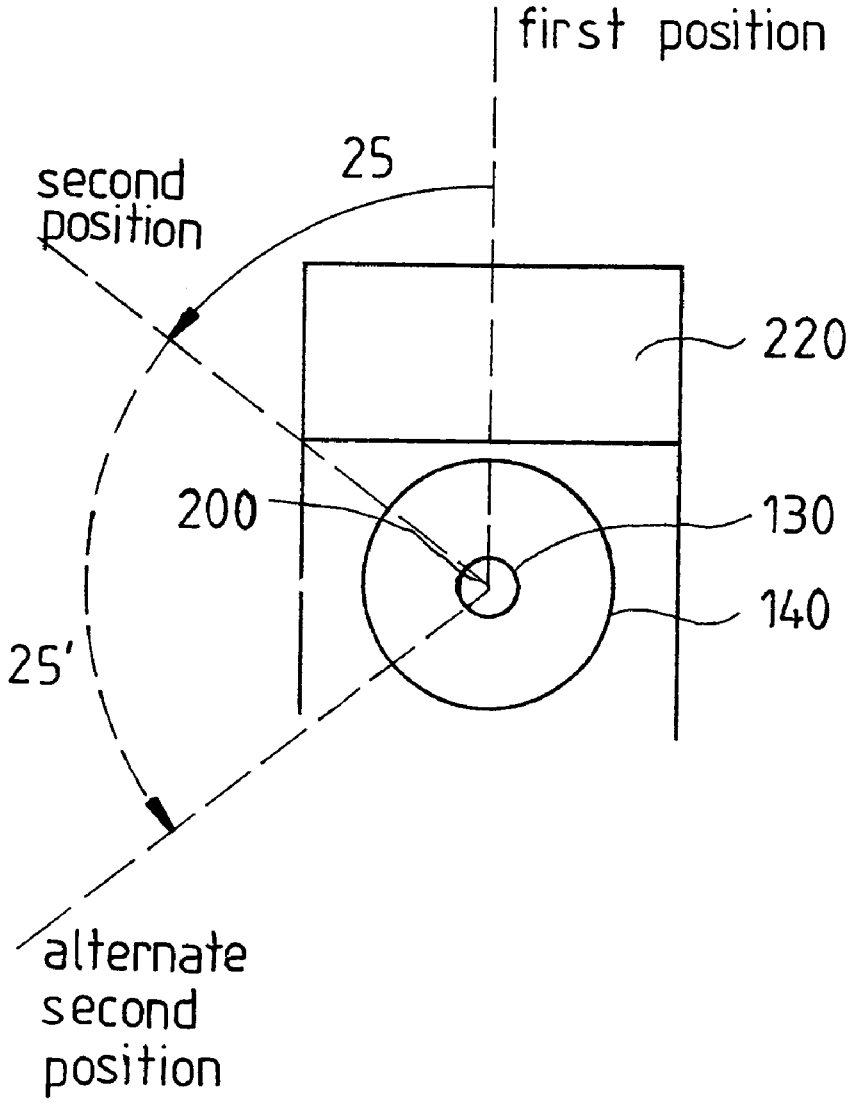
Figure 5C:
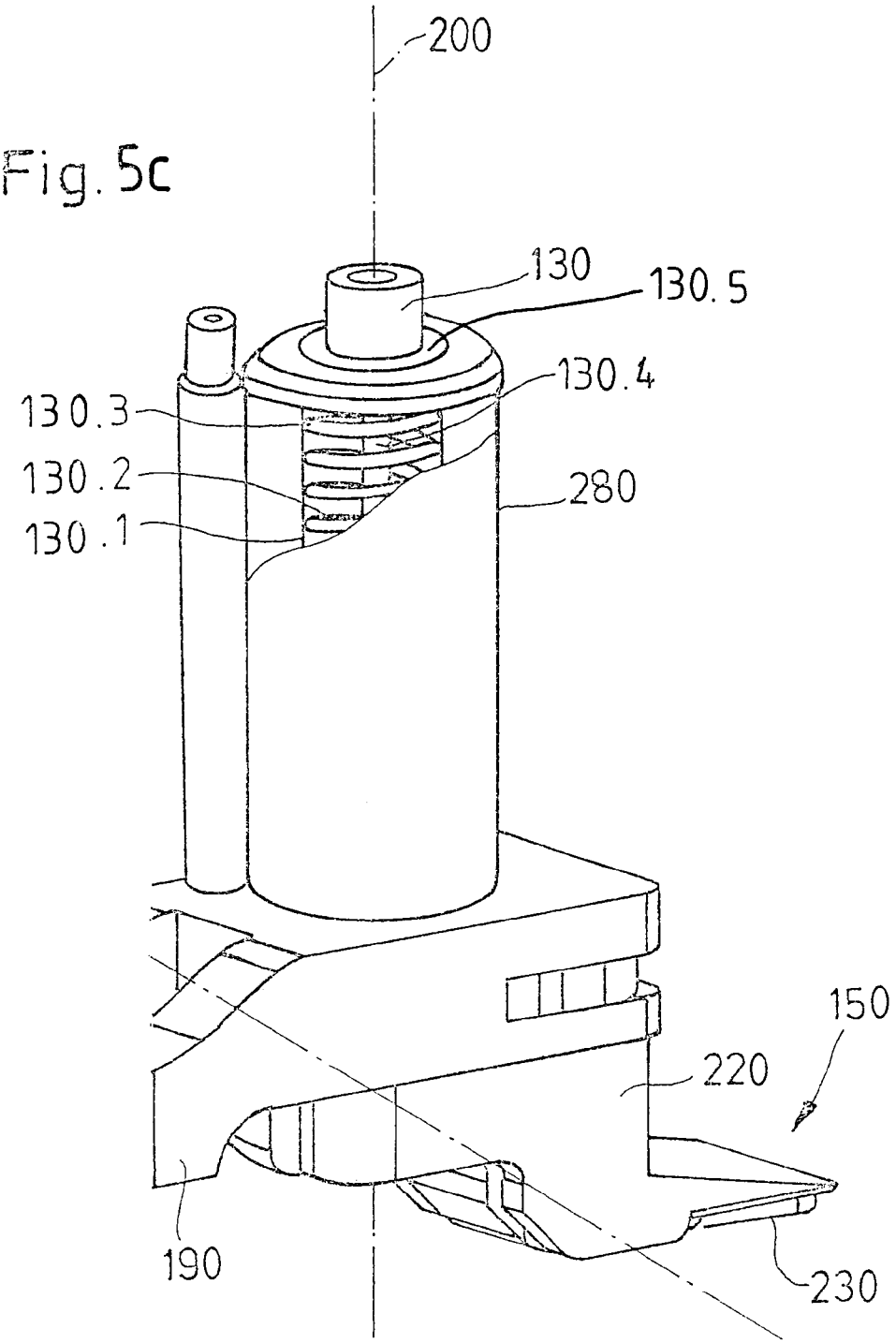
Figure 5D:
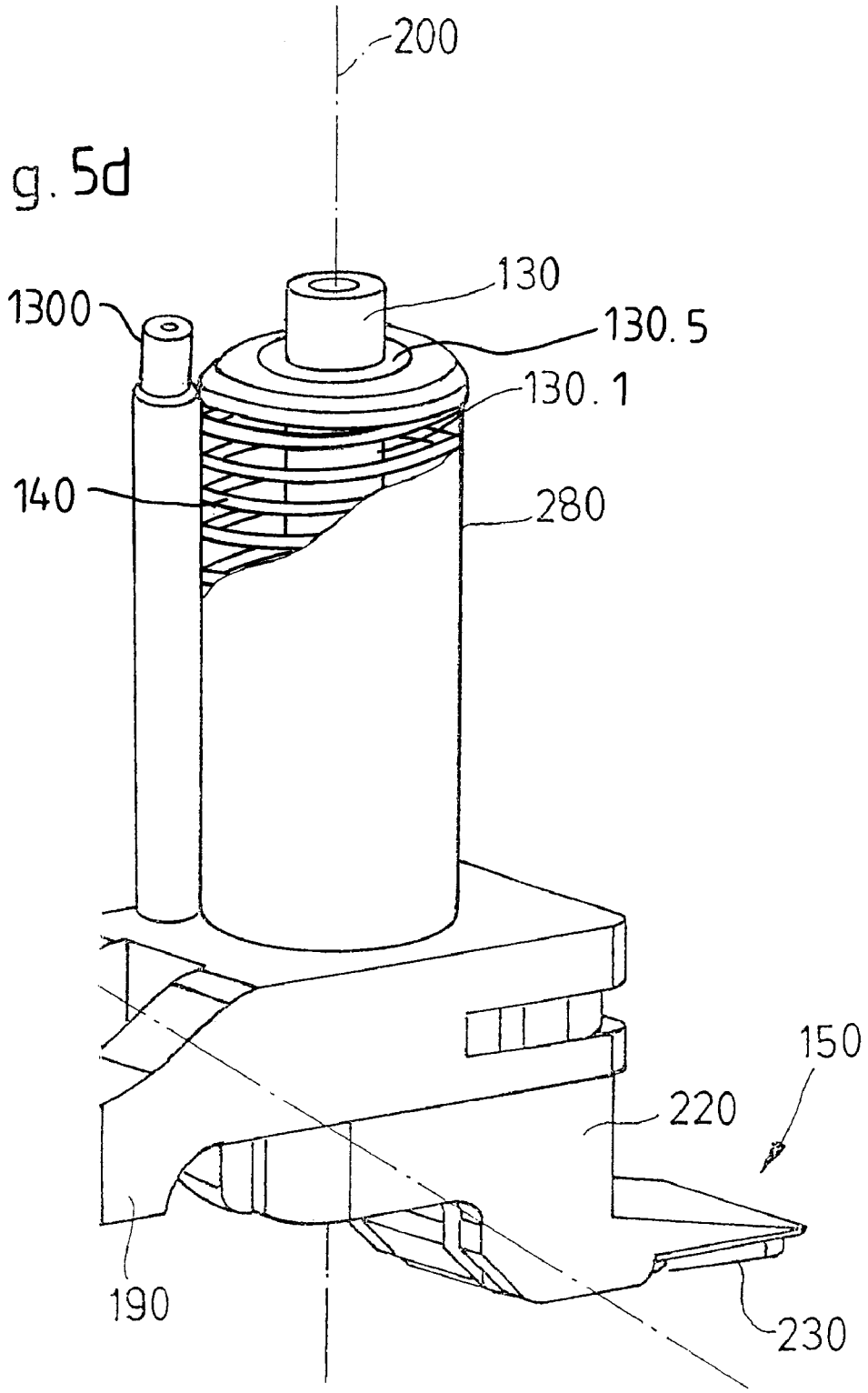

In operation, for example, each gripper element 5 grips each first signature 7 and each gripper element 6 grips each second signature 8. For example, FIG. 3(*b*) illustrates an exemplary embodiment of a deceleration device 100 handing-off signatures 7, 8 to respective gripper elements 5, 6. The deceleration device 100, shown in side view in FIG. 3(*c*), can be used for slowing down the signatures 7, 8 being delivered from a folder as described in, for example, U.S. Pat. No. 5,452,866 which is hereby incorporated by reference. As shown in FIG. 3(*b*), gripper blocks 1, 2 are attached to respective conveyor cables 3, 4 and follow a path next to the deceleration device 100. By arranging the gripper blocks 1, 2 and conveyor cables 3, 4 to follow the path next to the deceleration device 100, the respective gripper elements 5, 6 can grab the signatures 7, 8 as the deceleration device 100 releases each respective signature 7, 8.

Once a signature 7, 8 is handed off from the deceleration device 100 to the respective gripper element 5, 6, conveyor cables 3, 4, to which the gripper blocks are attached via, for example, detente locking mechanism 13, guide signatures 7, 8 along a parallel path until the point where second conveyor cable 4 deviates from the path of first conveyor cable 3, as shown in FIG. 2. At the same time cable 4 deviates from the path of cable 3, each second signature 8 also deviates from the path of each first signature 7, and thereafter follows a separate path, also shown in FIG. 2.

The exemplary design of the gripper blocks according to the present invention shown in FIG. 4 allows the separation of the gripper blocks 1, 2 and thus the signatures 7, 8. Upon reaching a predetermined position, for example, at the point where signatures 7, 8 are aligned directly above separate respective belt conveyors at, for example locations X and Y, signatures 7, 8 are released from grippers 5, 6 as they have become fully separated from each other and thereby form separated signatures 7, 8 for further processing such as, for example, binding. After the signatures 7, 8 are released from their respective gripper elements 5, 6, the paths of conveyor cables 3, 4 rejoin as they guide gripper blocks 1, 2 and gripper elements 5, 6 back towards the folder.

An additional feature of the post-folder diverting apparatus according to the present invention is depicted in FIG. 2. For example, signatures 7, 8 can be rotated relative to the gripper blocks 1, 2, thus enabling the signatures 7, 8 to be continuously oriented in a folded edge leading orientation.

FIGS. 5(*a*)–(*d*) show an exemplary gripper 5, 6 according to the present invention that can rotate relative to the gripper block in greater detail. The rotation axis 200 extends perpendicular to the conveying direction 270, thus allowing the gripper head 150 to rotate. The rotational movement of gripper head 150 extends, as shown, approximately 45 degrees through the given angle 25 as shown in FIG. 5(*b*), but can also be adjusted to accommodate other rotational positions, indicated by second alternate position 25'.

FIG. 5(*c*) shows a cross-section through a portion of a gripper element 5, 6. The first actuating pin 130 is linked with a moveable portion 230 of a product gripper head 150 via a rod 130.4. A stationary portion 220 of the product gripper head 150 is mounted to the support 190. By applying pressure to the first actuating pin 130, the moveable portion 230 of the gripper element 5, 6 is moved downward releasing a product held between the stationary portion 220 and the moveable portion 230. Within a housing 130.1, a spring 130.3 is pretensioned between an upper support 130.5 and a lower support 130.2, the upper support 130.5 mounted to the rod 130.4. When pressure is applied to the actuating pin 130, and the rod 130.4 moves the movable portion 230 downward as described above, the spring 130.3 compresses. Once pressure is removed from the rod 130.4, the compressed spring expands, moving the movable portion upward towards the stationary portion 220.

Referring to FIG. 5(*d*), on the support 190, a pretensioning device such as a spring 140 is mounted for facilitating the rotational movement of the gripper head 150. A second actuating pin 1300 is provided for actuating rotational movement of the gripper head 150 about the axis 200. Prior to the entry into the folder, a cocking mechanism (e.g., a post appropriately mounted in the path of the gripper head 150) engages the gripper head 150 and rotates it into a first (cocked) position as shown in FIG. 5(*b*). In the first position, the spring 140 is held in tension by an actuation device (e.g., a tab holding one end of the spring 140). When the second actuating pin 1300 is subsequently pressed, it causes the actuating mechanism to release the spring 140 from tension and the gripper head gradually rotates counterclockwise along the angle 25 into the second (rotated) position as shown in FIG. 5(*b*). As described in more detail below, triggering of the second actuating pin 1300, as well as triggering of the first actuating pin 130, can be accomplished by actuating mechanisms 340 (not shown) in a variety of ways.

While the rotation of the gripper head 150 has been described above with respect to a spring actuated mechanism, it should be clear that other rotation mechanisms are also acceptable. For example, rotation of the gripper head 150 could be accomplished with conventional hydraulic or pneumatic mechanisms. Alternatively, an electrically controlled motor could be used. Moreover, it should be clear that the gripper head 150 can be returned to the first position under the control of a pneumatic, hydraulic, or electrically controlled mechanism. Rotation from the second position to the first position could then be triggered, for example, by providing an additional actuating pin, or by toggling the actuating pin 1300. Similarly, while the actuating pin 130 is illustrated as opening the gripper 150 by means of a spring mechanism, it should be clear that a hydraulic or pneumatic mechanism, or any other suitable device, could also be used. The gripper mechanism according to the present invention as shown in FIGS. 5(*a–d*), for example, grips and conveys signatures in an overlapping stream configuration. The gripper mechanism has gripper jaws designed, for example, to grasp a corner of a signature.

FIG. 3(*a*) shows a side view of the post-folder diverting apparatus according to the present invention shown in FIG. 2 at the portion where conveyor cables 3, 4 follow a common, parallel path. Gripper blocks 1, 2 connected to conveyor cables 3, 4 are guided by a common guide track 11. For example, guide track 11 steers gripper blocks 1, 2 and gripper elements 5, 6 along a predetermined common path to position them for gripping and guiding respective signatures 7, 8, for example upon receipt of the signatures 7, 8 from a deceleration device 100 as shown in FIG. 3(*b*). In the embodiment shown in FIG. 3(*b*), wheels 12, for example, are attached to gripper blocks 1, 2 to allow gripper blocks 1, 2 to roll within guide track 11. Gripper elements 5, 6 grip signatures 7, 8 as discussed above. Other embodiments are possible, for example, in which gripper blocks without wheels slide along the guide track such as by selecting the appropriate material for construction of the gripper blocks and/or the guide track so as to have a desired coefficient of friction, such as forming the gripper blocks 1, 2 from a self lubricating plastic or nylon.

What is claimed is:

1. A gripper block, comprising:

a first portion having a recess therethrough for receiving and connecting to a first cable; and a second portion adjacent to the first portion, the second portion having a second recess therethrough, the second recess configured to allow a second cable to pass through and to allow the second cable to separate from the second recess.

2. The gripper block according to claim 1, wherein the first portion further includes a detente locking mechanism releasably engaging the first portion to the first cable.

3. The gripper block according to claim 1, further comprising a gripper element connected to the first portion.

4. The gripper block according to claim 1, further comprising a gripper element connected to the second portion.

5. The gripper block according to claim 1, wherein the first portion and the second portion have a unitary construction.

6. An apparatus for diverting a single stream of flat products, especially printed signatures, into two separate streams, comprising:

a first conveyor drive guiding a first conveyor cable attached thereto along a first path;

a second conveyor drive guiding a second conveyor cable attached thereto along a second path, a portion of the second path adjoining the first path;

a plurality of first gripper blocks each having a gripper element attached thereto, each of the plurality of first gripper blocks being connected to the first conveyor cable;

a plurality of second gripper blocks each having a gripper element attached thereto, each of the plurality of second gripper blocks being connected to the second conveyor cable;

wherein each of the plurality of first gripper blocks includes a first portion and a second portion, the first portion having a first recess therethrough for receiving and connecting to the first conveyor cable, the second portion having a second recess therethrough to allow the second conveyor cable to pass therethrough to allow the second conveyor cable to move relative to the second recess; and wherein each of the plurality of second gripper blocks includes a first portion and a second portion, the first portion of each second gripper block having a third recess therethrough for receiving and mounting to the second conveyor cable, the second portion of each second gripper block having a fourth recess to allow the first conveyor cable to pass therethrough and to allow the first conveyor cable to move relative to the fourth recess.

7. The apparatus according to claim 6, wherein the first portion of each of the plurality of first gripper blocks further includes a first detente locking mechanism releasably engaging the first portion to the first conveyor cable and the first portion of each of the plurality of second gripper blocks further includes a second detente locking mechanism releasably engaging the first portion to the second conveyor cable.

8. A method for diverting a single stream of flat products, especially printed signatures, into two separate streams, comprising the steps of:

(a) gripping a first product with a first gripper element attached to a first gripper block mounted to a second conveyor cable;

(b) gripping a second product with a second gripper element attached to a second gripper block mounted to a second conveyor cable;

(c) guiding the first and second conveyor cables along the common path for a first duration and along the separate paths for the second duration; and (d) transporting each of the first and second products along the common path for the first duration and along the separate paths for the second duration, wherein the first gripper block includes a first portion and a second portion, the first portion of the first gripper block having a first recess therethrough for receiving and connecting to the first conveyor cable, the second portion of the first gripper block having a second recess therethrough to allow the second conveyor cable to pass therethrough to allow the second conveyor cable to move relative to the second recess, and the second gripper block includes a first portion and a second portion, the first portion of the second gripper block having a third recess therethrough for receiving and mounting to the second conveyor cable, the second portion of the second gripper block having a fourth recess to allow the first conveyor cable to pass therethrough and to allow the first conveyor cable to move relative to the fourth recess.

9. The method according to claim 8, further comprising the step of:

(e) releasing each of the first and second products into separate product streams during the second duration.

10. The method according to claim 8, wherein the first and second gripper blocks are connected to the respective first and second conveyor cable via a respective detente locking mechanism.

* * * * *